US006954956B1

(12) United States Patent
Diaz

(10) Patent No.: US 6,954,956 B1
(45) Date of Patent: Oct. 18, 2005

(54) FIRE-RETARDANT MATTRESS

(76) Inventor: Vincent Diaz, 2303 Tide Cir., Havre de Grace, MD (US) 21078

( * ) Notice: Subject to any disclaimer, the term of this patent is extended or adjusted under 35 U.S.C. 154(b) by 33 days.

(21) Appl. No.: 10/455,669

(22) Filed: Jun. 5, 2003

Related U.S. Application Data

(63) Continuation-in-part of application No. 10/261,895, filed on Oct. 1, 2002, now Pat. No. 6,718,583.

(51) Int. Cl.[7] ..... A47C 27/00
(52) U.S. Cl. ..... 5/698; 5/737; 5/739
(58) Field of Search ..... 297/DIG. 5; 5/698, 5/737, 739

(56) References Cited

U.S. PATENT DOCUMENTS 3,818,521 A * 6/1974 Richards, Jr. ..... 5/698
3,889,305 A * 6/1975 Goldberg ..... 5/698
4,430,765 A * 2/1984 Karpen ..... 5/698
4,463,464 A * 8/1984 Bost et al. ..... 297/452.61
4,463,466 A 8/1984 May et al.
4,504,991 A * 3/1985 Klancnik ..... 5/698
4,866,799 A * 9/1989 Glackin ..... 5/698
5,475,881 A * 12/1995 Higgins et al. ..... 5/737
5,578,368 A * 11/1996 Forsten et al. ..... 442/407
6,609,261 B1 * 8/2003 Mortensen et al. ..... 5/698

* cited by examiner

*Primary Examiner*—Michael Trettel
(74) *Attorney, Agent, or Firm*—Armstrong, Kratz, Quintos, Hanson & Brooks, LLP

(57) ABSTRACT

A fire retardant pillow top mattress has a base which is covered by a fire barrier material. A ticking covers the fire barrier material. Sheets of these combined materials are formed into a top, a bottom and side walls for the mattress, the pillow top and the gusset between the mattress and the pillow top. The intersecting planar surfaces are mated between a fire-retardant treated edge binding tape. The mated surfaces are sewn with a fire retardant thread and the mattress, pillow top and gusset are encapsulated with fire retardant components.

11 Claims, 7 Drawing Sheets

FIRE-RETARDANT MATTRESS

CROSS REFERENCE TO RELATED APPLICATIONS

This application is a continuation-in-part of application Ser. No. 10/261,895 filed Oct. 1, 2002 and now U.S. Pat. No. 6,718,583, the disclosure of which is incorporated by reference herein in its entirety.

BACKGROUND OF THE INVENTION

1. Field of the Invention

The present invention relates to a mattress which is fire-retardant and does not burn when exposed to elevated temperatures and flame and more particularly, to a mattress having at least one pillow attached thereto.

2. Description of Related Art

In the United States mattress fires cause the deaths of approximately 500 people each year. One of the main causes of these fires is children playing with matches.

The incidence of mattress fires throughout the United States is such that the industry has formed committees to attempt to establish standards for testing flammability of mattresses. The state of California enacted Assembly Bill 603(AB603) in 2001 which requires all mattresses to be sold effective January 2004 to meet the performance requirements of California Technical Bulletin 129 and subsequently California Technical Bulletin 603(TB603). The Consumer Product Safety Commission is considering regulations which would require that mattresses be required to pass an open flame test which would be mandatory nationwide.

The foam, used within the mattress for cushioning, is a potential source of fuel which can be ignited and quickly engulf the mattress in flames. The foam is highly flammable. Not only is the foam flammable, but when burning, it emits noxious fumes. Furthermore, in the construction of the mattress, the sewing thread, used to secure the perimeter of the mattress, is a thread made of nylon or other fibers. These threads are flammable and will melt when exposed to direct flame. The flammability of the present mattresses is aggravated by these types of thread. These threads melt at the temperature of a burning match, which is approximately 460° F. When the thread is destroyed the structural integrity of the mattress is destroyed. The flame frequently travels around the periphery of the mattress where the threads join the top and the sidewalls. This flame then ignites the foam within the mattress which fuels the fire to a catastrophic event.

There is interest from the ASTM International, a national consensus standards organization, on this subject. Specifically, Subcommittees E5.15 which is responsible for household furnishings and D13.52 which is responsible for flammability of textiles, have initiated the development of a standard to evaluate the performance of components which can be used to improve the ability of mattresses to withstand an open flame.

In a related area, aircraft seat manufacturers are concerned about the flame resistance of the seats to meet the performance requirements of Federal Aviation Regulations (FAR) 25.833.

BRIEF SUMMARY OF THE INVENTION

It is an object of the present invention to provide a mattress, a sofa cushion and a pillow which, when exposed to an open flame, will not burn.

It is a further object of the present invention to provide a fire retardant mattress which is easily produced and is economical to manufacture.

It is another object of the present invention to provide a fire retardant mattress which will meet the requirements established by government agencies.

It is still another object of the current invention to provide a fire retardant pillow mattress which additionally protects the gusset around the mattress.

In accordance with the teachings of the present invention, there is disclosed a fire-retardant mattress to be disposed on a foundation, having at least one pillow top formed thereon. The mattress has a base having sides and at least one pillow top, a fire barrier material, a fire retardant sewing thread, and a treated flame retardant tape. The sides of the base are substantially covered with the fire barrier material. The fire barrier material extends circumferentially around the base between peripheral edges. The pillow top has a cover formed from the flame barrier material wherein the cover has an outer end circumferentially around the pillow top. At least one gusset is formed between the sides of the base and the at least one pillow top. The at least one gusset is disposed circumferentially around the mattress. The at least one gusset has a first wall and a second wall. The gusset walls each have a cover formed from the fire barrier material, the gusset walls being opposed to and angularly disposed with respect to one another. The gusset wall covers form an apex within the at least one gusset. The fire retardant sewing thread securing the gusset wall covers at the apex. Each gusset wall cover has an end distal from the apex of the at least one gusset. The end of the first gusset wall cover forms a first joint with the outer end of the cover of the pillow top. The treated flame retardant tape covers the first joint. The fire retardant sewing thread secures the tape and the first joint. The end of the second gusset wall cover forms a second joint with the peripheral edge of the fire barrier material covering the sides of the base. The treated flame retardant tape covers the second joint. The fire retardant sewing thread secures the tape and the second joint. In this manner the mattress with the pillow top is capable of withstanding exposure to flame without igniting.

In further accord with the teachings of the present invention, there is disclosed in a pillow top mattress having a mattress member and a pillow top member, a gusset formed circumferentially between the mattress member and the pillow top member. The gusset has a first wall and an opposite second wall, the walls forming an apex within the gusset. The mattress has a fire barrier material, a fire retardant sewing thread, and a treated fire retardant tape. Each of the two walls of the gusset have a cover formed from the fire barrier material. The apex of the covered walls of the gusset is secured with the fire retardant sewing thread. Each gusset wall cover has a respective end distal from the apex. The end of the first gusset wall cover is mated with an outer end of a cover of the pillow top member. The cover of the pillow top member is formed from the fire barrier material. The mated ends are covered with the treated fire retardant tape and secured with the fire retardant sewing thread. The end of the second gusset wall cover is mated with a peripheral end of a cover for a side wall of the mattress member. The cover for the side wall of the mattress member is formed from the fire barrier material. The mated ends are covered with the treated fire retardant tape and secured with the fire retardant sewing thread. In this manner the pillow top mattress withstands exposure to flame without ignition.

In still further accord with the teachings of the present invention, there is disclosed a method of making a fire retardant pillow top mattress. A base is provided forming a mattress member and at least one pillow member and defining at least one gusset between the mattress member and the at least one pillow member. A fire barrier material and a ticking covering the fire barrier material is provided thereby forming a sheet of material. The sheet of material is formed into a cover for the at least one pillow member, into side walls for encircling the mattress member, and into a first and a second side wall for the at least one gusset. A fire retardant sewing thread and a treated fire retardant tape are provided. The apex of the at least one gusset is covered with the first and second side walls of the at least one gusset and the first and second side walls at the apex are secured with the fire retardant sewing thread. The first and second side walls each have an end distal from the apex. The end of the first gusset side wall is mated with the outer end of the cover from the at least one pillow top. The mated ends are covered with the treated fire retardant tape, and the covered mated ends are secured with the fire retardant sewing thread. The end of the second gusset side wall is mated with a peripheral end of the side wall for the mattress member. The mated ends are covered with the treated fire retardant tape. The covered mated ends are secured with the fire retardant sewing thread. In this manner the entire pillow top mattress is covered with the fire barrier material and all joined and mated ends are covered with the treated fire retardant tape and secured with the fire retardant sewing thread such that the foam base is protected from exposure to flame.

These and other objects of the present invention will become apparent from a reading of the following specification taken in conjunction with the enclosed drawings.

DESCRIPTION OF THE PREFERRED EMBODIMENTS

Figure 1:
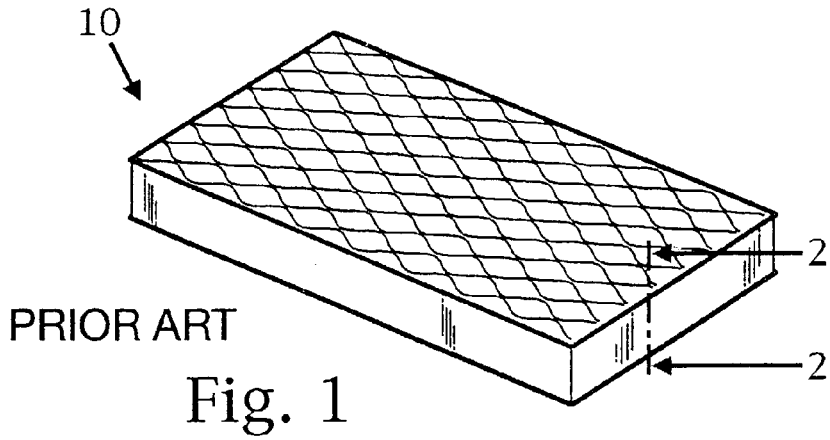
FIG. 1 is a perspective view of a mattress of the prior art.
Figure 2:
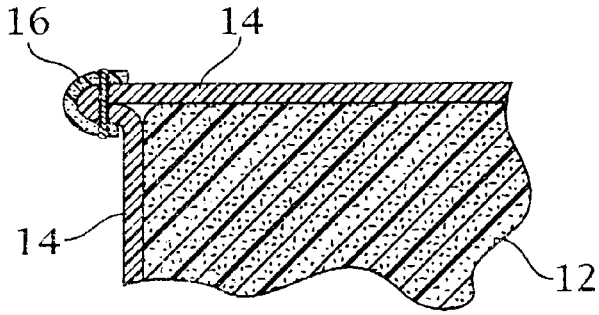
Fig. 2 PRIOR ART
FIG. 2 is a cross-sectional view taken across the lines 2—2 of FIG. 1.
Figure 3:
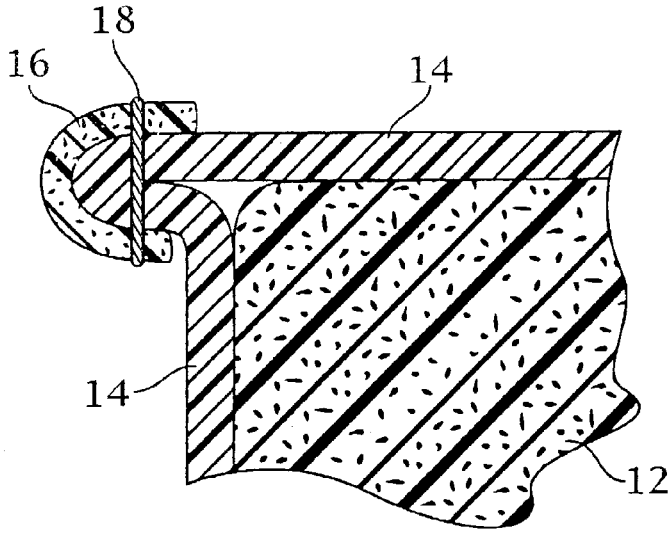
Fig. 3 PRIOR ART
FIG. 3 is an enlarged view of two intersecting planar surfaces of the mattress of FIG. 2.

Referring to FIGS. 1–4 in the prior art, a mattress 10 is formed by placing a flammable foam material 12 over a frame, usually having springs on the frame. A ticking 14 or dress cover fabric is made as a cover directly attached to the foam 12. The mattress 10 has a top, a bottom and four sidewalls connecting the top and bottom. These sidewalls intersect the perimeters of the planar top and bottom surfaces. At the intersection, the respective ticking are sandwiched between an edge binding 16 which encompasses the entire top perimeter. A similar edge binding 16 encompasses the entire bottom perimeter. The edge binding is sewn together to assemble the mattress.

Figure 4:
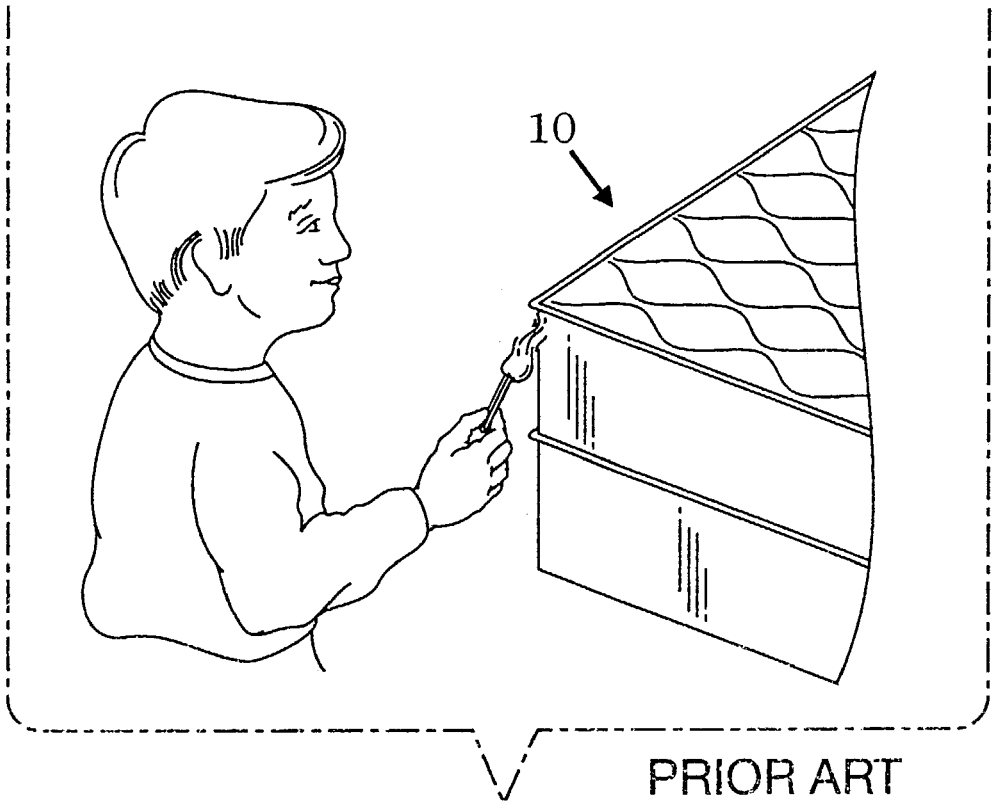
FIG. 4 is a diagram of ignition of the mattress of the prior art by a child playing with matches.

In the prior art, the ticking 14 is usually a polypropylene, polyester or nylon fabric. The edge binding 16 is generally made from an untreated polyester material. The edge binding and ticking are sewn together using a polymeric thread 18. None of the component materials are usually made from fire retardant or flame resistant material. When exposed to elevated temperatures or an open flame, all of the components will burn or melt to fuel the fire and/or to deform and no longer retain the shape of the mattress. One of the major causes of mattress fires is children playing with matches (FIG. 4).

Figure 5:
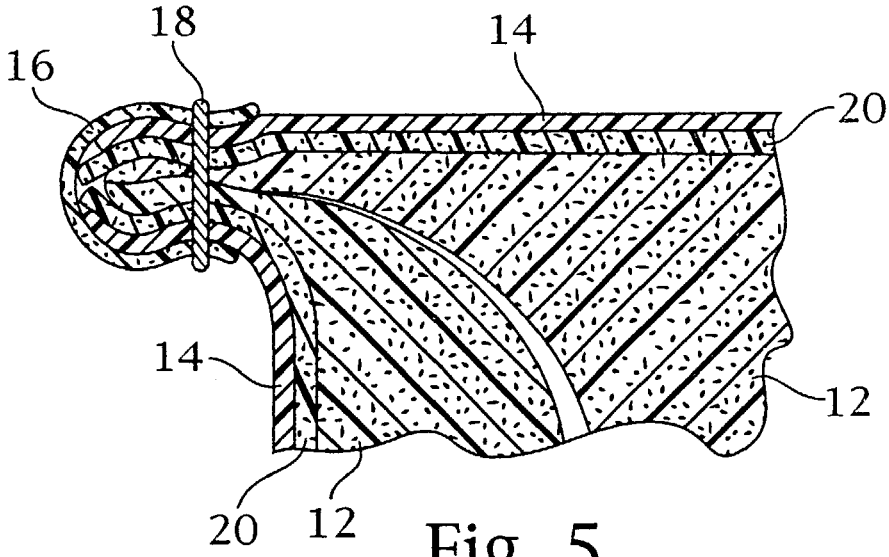
FIG. 5 is a cross-sectional view of the two intersecting planar surfaces of the mattress of the present invention.

In the present invention, FIG. 5, the ticking 14 is attached to a first face of a fire barrier material 20. A preferred fire barrier material is an aramid fiber which is made by E.I. DuPont de Nemours & Co. and sold as KEVLAR®. Other known fire barrier materials which are known are preoxidized acrylic and fiberglass. The acrylic material and the fiberglass are both uncomfortable on the skin of persons and are less desirable for use in mattresses. The ticking 14 is preferably sewn to the fire barrier material 20. On the opposite face of the fire barrier material 20, the foam 12 is attached. The fire barrier material 20 preferably has a weight ranging from 2 oz./sq. yd. to 5 oz./sq. yd. This defines a thickness of the fire barrier material 20 which can withstand an open flame for a sufficient time to be considered to provide a fire retardant mattress.

Figure 6:
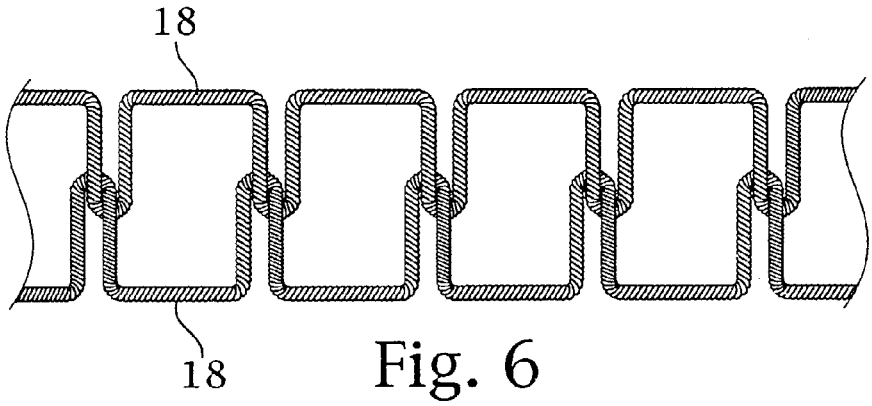
FIG. 6 is a diagramatic view of a chain stitch.
Figure 7:
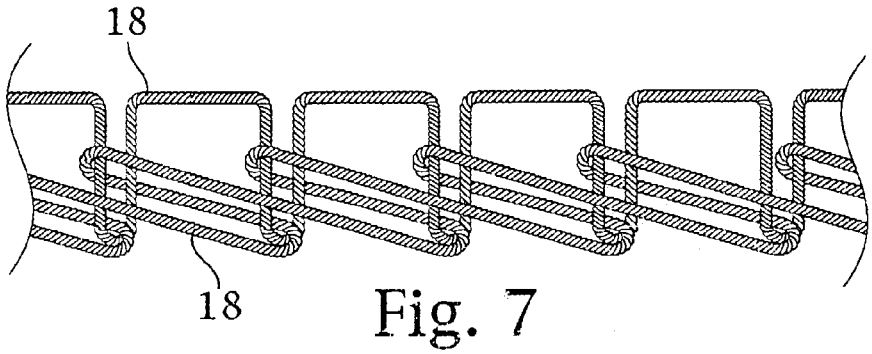
FIG. 7 is a diagramatic view of a lock stitch.

The top and bottom of the mattress 10 are usually made, using much thicker foam 12. The sidewalls of the mattress usually have a thinner foam. The sidewalls intersect the perimeters of the top and bottom surfaces of the mattress. At the intersection, as shown in FIG. 5, the foam 12 layer of the outer edges of the top (and the bottom) are placed adjacent to the foam 12 layer of the sidewall. The respective ticking 14 of the top (and the bottom) are disposed distal from the ticking on the sidewalls. The edges are sandwiched between the folded edge binding tapes 16 which encompass the entire perimeter of the top and the bottom of the mattress 10. The foam 12 layers are compressed within the folded edge binding tapes 16 and the edge binding tapes are sewn with a thread 18 preferably using a lock stitch or a chain stitch (FIGS. 6–7) in accordance with stitch type 301 or 401 of ASTM D6193.

The edge binding tape 16 of the present invention preferably is a polyester material which is treated for flame retardency. The treated tape can also withstand washing.

The thread 18 of the present invention preferably is formed from material which is fire resistant such as aramid fiber. CRAQ-SPUN® sewing threads made of aramid fibers provided by Atlantic Thread and Supply Co., Inc. has been used successfully as the thread. The thickness of the thread may be selected for strength and cost. It is possible to use one thickness of thread in the needle thread of the sewing machine and a different thickness of thread in the bottom thread of the sewing machine. By a proper selection of thread thickness, the overall strength of the seam can be adjusted. The strength of the seam is an important factor because the foam portion of the top (and bottom layer) is very thick and is highly compressed when sandwiched in the edge binding 16 with the thinner layer of foam from the sidewalls. The thread 18 must be strong enough to resist the stress of the compressed foam 12, the fire barrier material 20 and the ticking 14 which are all sandwiched in the folded edge binding 16.

Figure 8:
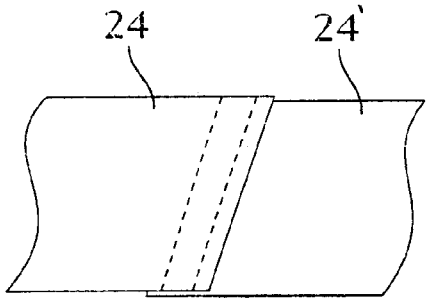
FIG. 8 is a perspective view of overlapping ends.
Figure 9:
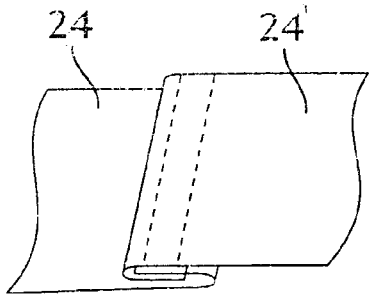
FIG. 9 is a perspective view of another embodiment of overlapping ends.
Figure 10:
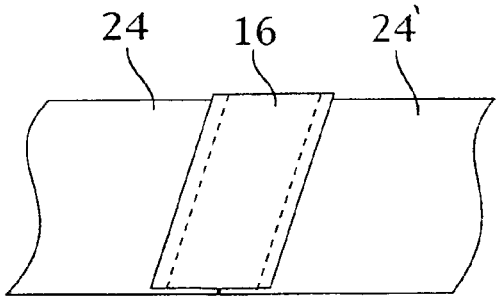
FIG. 10 is perspective view of a further embodiment of overlapping ends.

In manufacturing the mattress, the foam 12, the fire barrier material 20 and the ticking 14 are assembled in a single sheet which is large enough to form the respective planar surfaces of the top and bottom of the mattress. These are disposed on the frame. The sidewall 22 is usually formed from a single length of the assembled foam 12, fire barrier material 20 and ticking 14. The length of sidewall is placed around the frame and the top and bottom flanges are formed with the sidewall 22. The opposite ends 24, 24' of the sidewall 22 are overlapped and sewn together. Preferably, the foam 12 and ticking 14 are removed from the overlapping segments. If the foam and ticking are not removed, there is a possibility that, when exposed to an open flame, the foam and/or the ticking could ignite and the fire could travel through the overlapped segments and reach the foam within the mattress. This would compromise the fire retardant features of the mattress. FIGS. 8–10 show alternate overlapping seams which are recommended. These seams are made in accordance with ASTM D6193. FIG. 8 shows overlapping of the opposite ends 24, 24' of the sidewall and seaming with one or more rows of stitches. FIG. 9 shows the folding in and overlapping of the opposite ends 24, 24' of the sidewall so that the ends are concealed and seaming with one or more rows of stitching. FIG. 10 shows the overlapping of a strip of fire retardant material on the abutted opposite ends 24, 24' of the sidewalls and seaming with two or four rows of stitching. If the opposite ends 24, 24' of the sidewall 22 were simply butted together without any overlapping, the mattress would not withstand an open flame. The flame would ignite the foam 12 which would be exposed at the butted joint and the foam within the mattress 10 would burn. All of the overlapping seams are sewn with the fire retardant thread 18.

Figure 11C:
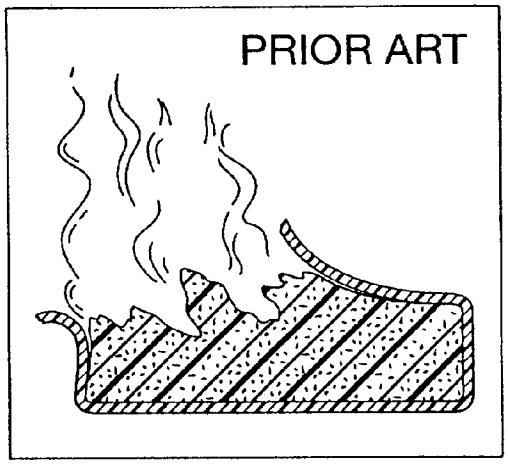
FIG. 11C has a cut-away view showing FIG. 11A with the entire mattress burning.
Figure 11B:
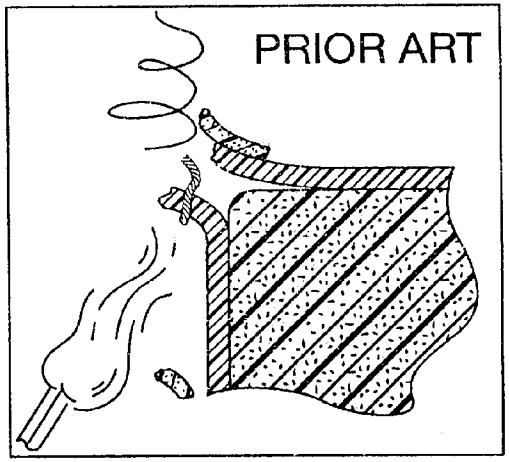
FIG. 11B has a cut-away view showing FIG. 11A and the stitching melted and the tape burning.
Figure 11A:
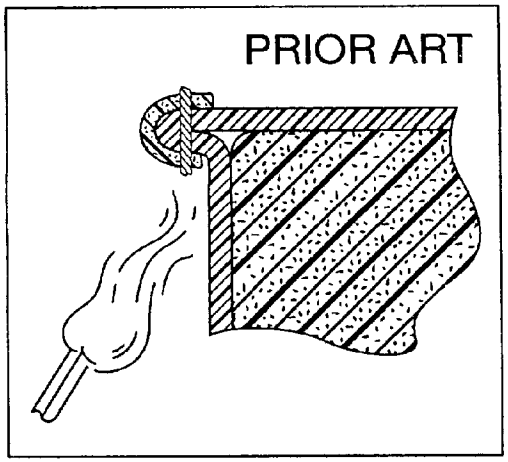
FIG. 11A has a cut-away view showing a flame applied to the prior art mattress.
Figure 11E:
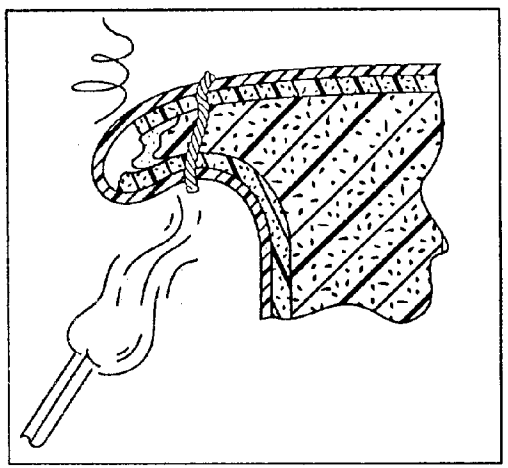
FIG. 11E is a cut-away view showing FIG. 11D retaining integrity after exposure to the open flame.
Figure 11D:
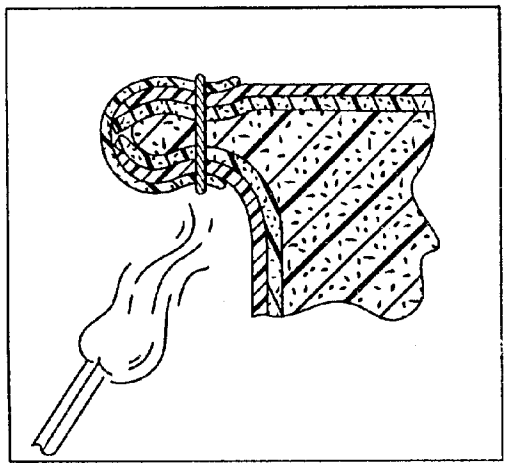
FIG. 11D is a cut-away view showing a flame applied to the present invention.

The effectiveness of the fire retardant properties of the present invention has been extensively tested against an open flame in accordance with California Technical Bulletin 129. This requires a methane flame at 1,200° F. which is much more severe than a burning match which burns at approximately 460° F. The continuous exposure time to the open flame is for three (3) minutes. After three (3) minutes, the ticking in the vicinity of the flame has been consumed or has melted. There is charring of the ticking around the outer areas which have been exposed to the flame. Also, charred remnants of the ticking cover the fire barrier material 20 (the aramid). The edge binding 10 is darkened and is somewhat embrittled, but is intact. The thread 18 through the flange is unaffected and retains the flange in its original shape. The mattress successfully passed this vigorous test (FIGS. 11D–11E).

It was noted that after the open flame was removed, an afterflame was occasionally observed on the flange, usually at the edges of the area exposed to the open flame. This was due to burning of the compressed foam which was in the flange. The afterflame burned out in a short time and did not ignite adjacent portions of the flange nor did it ignite the foam within the mattress.

If the thread is made from a polymeric fiber, as is presently used in the contemporary non-fire retardant mattresses, it has been found that these polymeric fibers melt. The edge binding tape is not retained over the flange and the foam is ignited. The mattress does not withstand the open flame test when nylon thread is used, even with the fire barrier material and the treated edge binding (FIGS. 11A–11C).

Pillow top mattresses have a foam mattress member 30 and a foam pillow member 32 with a gusset 34 therebetween. Two-sided pillow top mattresses have two pillow members 32 on opposite faces of the mattress and two gussets are formed. The potential for ignition and combustion is greater for a pillow top mattress than for a non-pillow top mattress because of the increased surface area. This is still further increased for a two-sided pillow top mattress.

Figure 12:
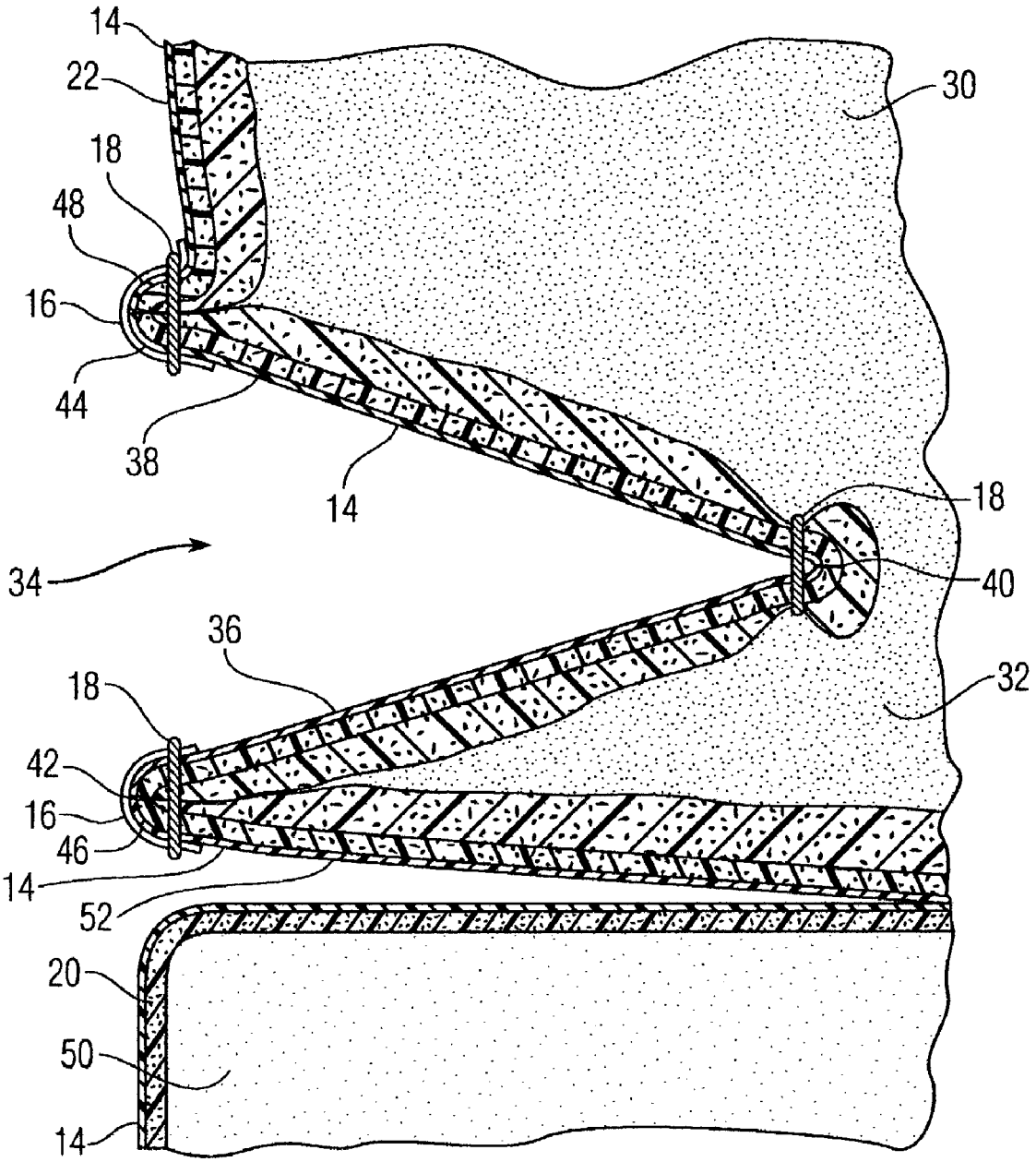
FIG. 12 is a partial cutaway view of the two-sided pillow top mattress resting on the foundation and showing the gusset.
Figure 13:
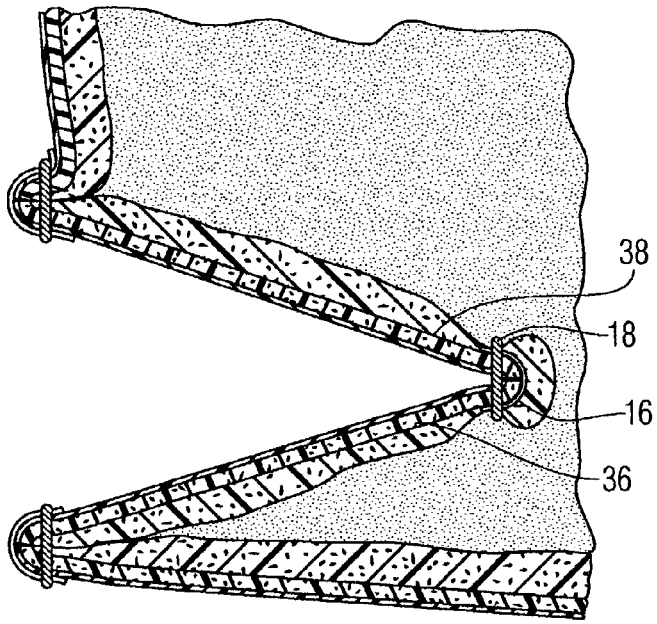
FIG. 13 is a partial cutaway view of the mattress showing the apex of the gusset covered with the tape.

As shown in FIG. 12 the gusset 34 has a first wall cover 36 and a second wall cover 38 formed from the ticking 14 and the fire barrier material 22. The walls 36, 38 are opposed to, and angularly disposed, with respect to one another. The walls 36, 38 form an apex 40 of the gusset 34. Preferably, the walls 36, 38 are a single, continuous piece of material which is folded at the apex 40 to reduce the possibility of ignition of the mattress member 30. The wall covers 36, 38 are secured by sewing with the fire retardant sewing thread 18. The sewing thread 18 pinches the wall covers 36, 38 together.

The gusset wall covers 36, 38 each have a respective end 42, 44 distal from the apex 40 of the gusset 34. The end 42 of the first gusset wall 36 is joined to an outer end 46 of the ticking 14 covered fire barrier material which covers the pillow member 32. Treated flame retardant tape 16 for edge binding covers the joint formed from the end 42 of the first gusset wall 36 and the outer end 46 of the pillow cover. 52 The fire retardant sewing thread 18 secures the tape 16 over the joint.

In a similar manner, the end 44 of the second gusset wall cover 38 is joined to the peripheral edge of the fire barrier material which covers the side wall 22 of the mattress member 30. Treated fire retardant tape 16 for edge binding covers the joint formed from the end of the second gusset wall and the side wall 48 of the mattress member. The fire retardant sewing thread 18 secures the tape 16 over the joint.

If desired, the apex 40 may be covered with the treated fire retardant tape 16 for edge binding and the tape 16 may be secured over the apex 40 with fire-retardant sewing thread 18.

Figure 14:
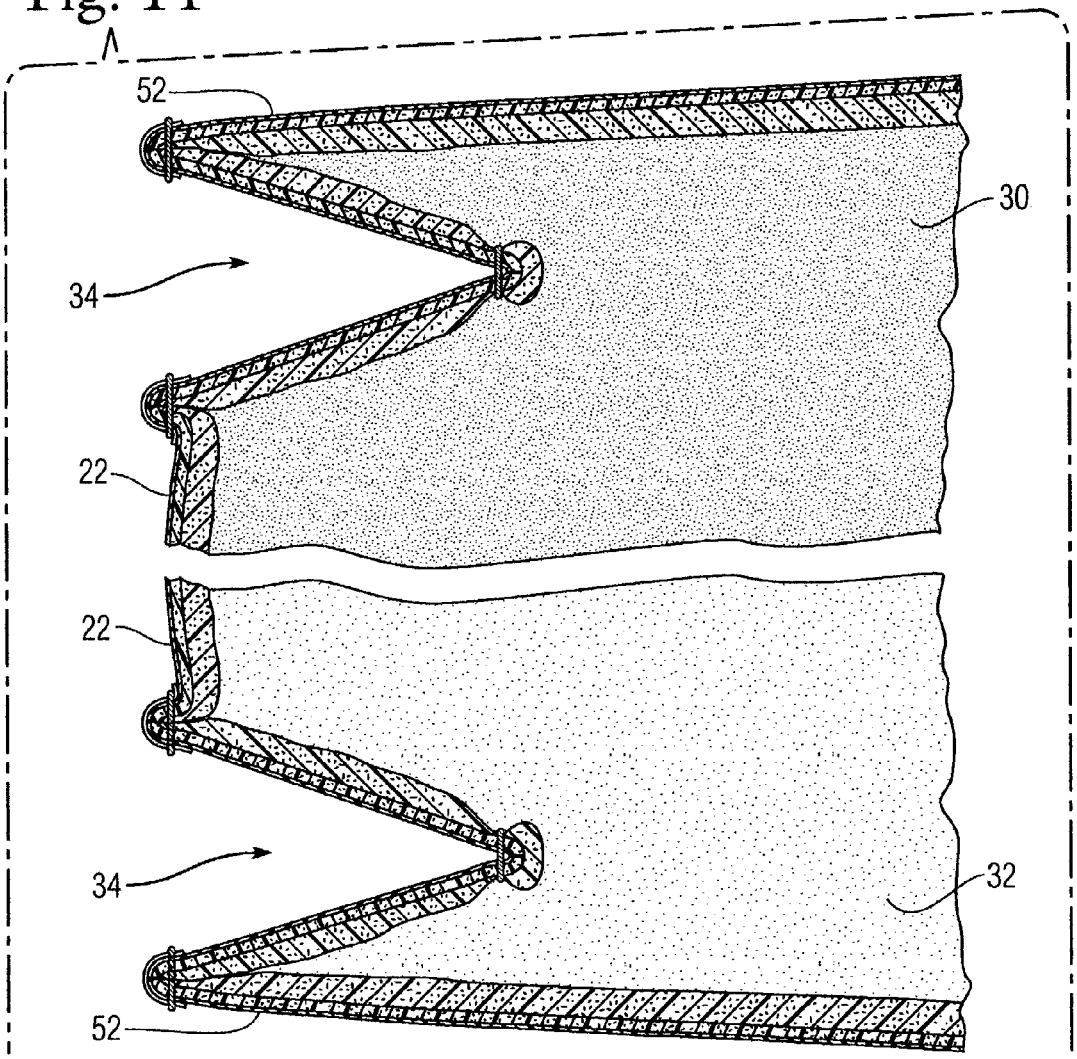
FIG. 14 is a cutaway view of a two-sided pillow top mattress.

As shown in FIG. 14, the two-sided pillow top mattress differs from the one-sided pillow top in that there are two gussets 34 which are separated by the side wall 22 of the mattress and which extend circumferentially around the mattress. Each gusset is identical.

The gusset 34 may have a depth of approximately as much as five (5) inches from the mouth to the apex.

The pillow top of the mattress is disposed on a foundation 50 such as a box spring. There is a potential for a large opening to be formed at the interface because of the shape of the pillow top. This opening could be the source of spreading of a fire or of ignition of an unprotected area. To minimize this possibility and to increase the fire retardant protection, the foundation 50 is covered with fire barrier material 20 to a distance of 6–8 inches inwardly from the outer side of the foundation as shown in FIG. 12.

Figure 15:
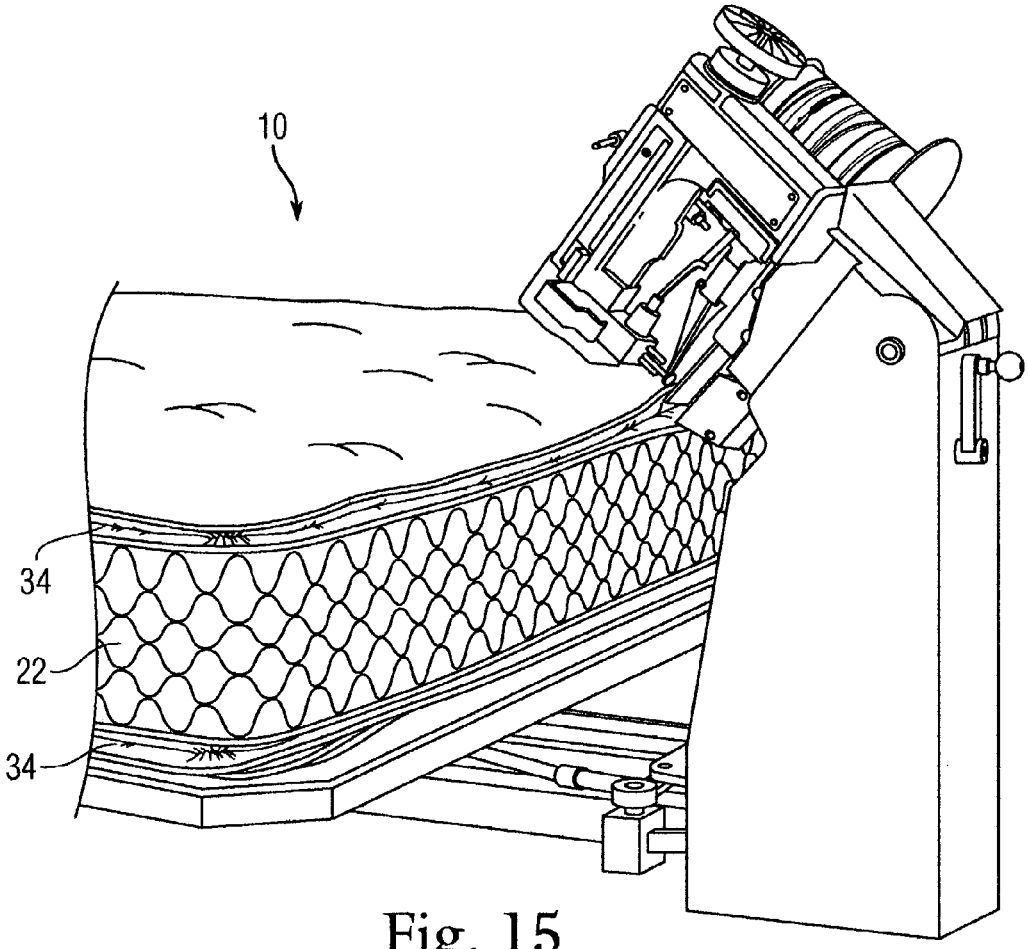
FIG. 15 is a perspective view of a two-sided pillow top mattress being sewed.
Figure 16:
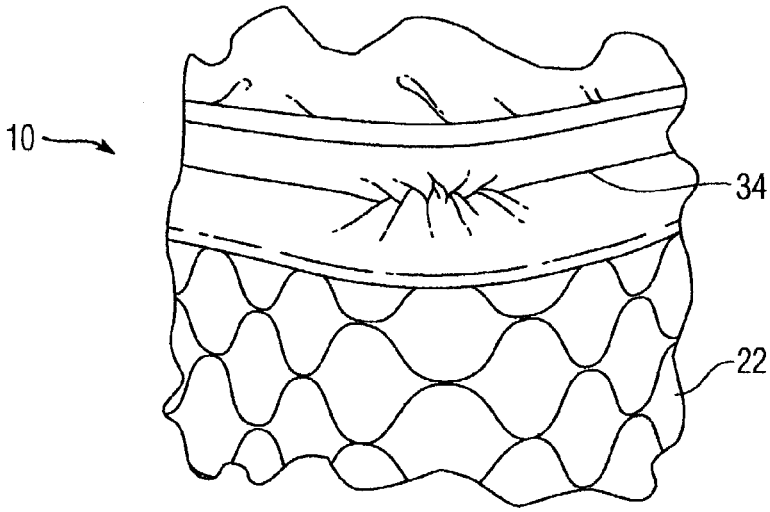
FIG. 16 is an enlarged perspective view of the gusset at the corner of the mattress.

The sewing of the outer edge of the cover with the end of the first gusset wall is shown in FIG. 15. An enlarged view of the gusset at a corner of the mattress is shown in FIG. 16.

It is preferred that the exterior fire barrier material be covered with a decorative ticking which may be quilted to a foam backing.

The present invention is an overall system to encapsulate the foam which is in the mattress and to prevent the foam from burning. The system is the fire barrier material, the treated edge binding tape and the fire resistant thread (aramid) in which the three components are interdependent. The system withstands an open flame and safeguards the structural integrity of the mattress to prevent ignition of the foam. The present invention solves a longstanding problem which the mattress and furniture industry has recognized and has not resolved.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A flame retardant mattress to be disposed on a foundation, the mattress having at least one pillow top formed thereon, the mattress comprising:

a base having sides and at least one pillow top, a fire barrier material, a ticking disposed externally of the fire barrier material, a fire retardant sewing thread, a treated flame retardant tape, a flammable foam attached internally adjacent to the fire barrier material, wherein the sides of the base are substantially covered with the ticking and fire barrier material, the fire barrier material extending circumferentially around the base between peripheral edges, the pillow top having a cover formed from the ticking and the fire barrier material, wherein the cover has an outer end circumferentially around the pillow top, at least one gusset formed between the side of the base and the at least one pillow top, the at least one gusset being disposed circumferentially around the mattress, the at least one gusset having a first wall and a second wall, the gusset walls each having a cover formed from the ticking and the fire barrier material externally of the foam, the gusset walls being opposed to and angularly disposed with respect to one another, the gusset wall covers forming an apex within the at least one gusset, the fire retardant sewing thread securing the gusset wall covers at the apex, each gusset wall cover having an end distal from the apex of the at least one gusset, the end of the first gusset wall cover forming a first joint with the outer end of the cover of the pillow top, the treated flame retardant tape covering the first joint and the foam compressed therein, the fire retardant sewing thread securing the tape, the compressed foam and the first joint, the end of the second gusset wall cover forming a second joint with the peripheral edge of the fire barrier material covering the sides of the base, the treated flame retardant tape covering the second joint and the foam compressed therein, the fire retardant sewing thread securing the tape, the compressed foam and the second joint, wherein the mattress with the pillow top is capable of withstanding exposure to flame without igniting.

2. The flame retardant mattress of claim 1, further comprising the foundation on which the mattress is disposed having an upper surface, the upper surface being formed from the fire barrier material and extending inwardly at least approximately six inches wherein spread of fire between the pillow top mattress and the foundation is retarded.

3. The flame retardant mattress of claim 1, wherein the fire retardant sewing thread is formed from aramid fiber.

4. The flame retardant mattress of claim 1, further comprising the apex of the gusset wall covers being sewn with the flame retardant sewing thread and securing the apex of the gusset wall cover.

5. The flame retardant mattress of claim 1, wherein the gusset walls are formed from a single continuous piece of the fire barrier material.

6. The flame retardant mattress of claim 1, wherein ticking is attached to fire barrier material.

7. In a pillow top mattress having a mattress member and a pillow top member, a gusset being formed circumferentially between the mattress member and the pillow top member, the gusset having a first wall and an opposite second wall, the walls forming an apex within the gusset, the improvement comprising:

a fire barrier material, a ticking disposed externally of the fire barrier material, a flammable foam disposed internally adjacent to the fire barrier material, a fire retardant sewing thread, a treated fire retardant tape, each of the two walls of the gusset having a cover formed from the ticking, the fire barrier material and the foam, the apex of the covered walls of the gusset being secured with the fire retardant sewing thread, each gusset wall cover having a respective end distal from the apex, the end of the first gusset wall cover distal from the apex being mated with an outer end of a cover of the pillow top member, the cover of the pillow top member being formed from the fire barrier material, the mated ends having the foam compressed therebetween being covered with the treated fire retardant tape and secured with the fire retardant sewing thread, the end of the second gusset wall cover distal from the apex being mated with a peripheral end of a cover for a side wall of the mattress member, the cover for the side wall of the mattress member being formed from the fire barrier material, the mated ends having the foam compressed therebetween being covered with the treated fire retardant tape and secured with the fire retardant sewing thread, wherein the pillow top mattress withstands exposure to flames without igniting.

8. The pillow top mattress of claim 7, wherein there are two pillow members, the pillow members being disposed on opposite faces of the mattress member, two gussets being formed circumferentially around the mattress, a respective gusset being formed between each pillow member and the mattress member.

9. The pillow top mattress of claim 7, further comprising the treated fire retardant tape covering the apex of the gusset wall covers, the flame retardant thread securing the tape and the apex.

10. A method of making a fire retardant pillow top mattress comprising the steps of:

providing a base forming a mattress member and at least one pillow member and defining at least one gusset between the mattress member and the at least one pillow member, the gusset having an apex therein, providing a fire barrier material, a flammable foam interiorly adjacent to the fire barrier material and a ticking covering the fire barrier material thereby forming a sheet of material, forming the sheet of material into a cover for the at least one pillow member, into side walls for encircling the mattress member, and into a first and second side wall for the at least one gusset, providing a fire retardant sewing thread, providing a treated fire retardant tape, covering the apex of the at least one gusset with the first and second side walls of the at least one gusset and securing the first and second side walls at the apex with the fire retardant sewing thread, the first and second side walls each having an end distal from the apex, mating the end of the first gusset side wall with an outer end of the cover from the at least one pillow top, covering the mated ends having the foam compressed therebetween with the treated fire retardant tape, securing the covered mated ends with the fire retardant sewing thread, mating the end of the second gusset side wall with a peripheral end of the side wall for the mattress member, covering the mated ends having the foam compressed therebetween with the treated fire retardant tape, securing the covered mated ends with the fire retardant sewing thread, wherein the entire pillow top mattress is covered with the fire barrier material and all joined and mated ends are secured with the fire retardant sewing thread such that the base is protected from exposure to flame.

11. A fire retardant mattress comprising a foam base, a fire barrier fabric attached to and substantially covering the foam base, a ticking covering the fire barrier material, a fire retardant tape forming an edge binding for the mattress around the perimeter thereof, the ticking and the fire barrier fabric with the attached foam base being sandwiched between the edge binding, thereby forming a laterally-projecting flange, and the flange being held together by a stitched fire retardant sewing thread, the thread and the fire retardant tape of the edge binding being capable of withstanding very high temperatures without rendering the foam vulnerable to the flames, and yet retaining the structural integrity of the mattress as a whole, the mattress further having at least one pillow top formed thereon, the pillow top having a cover formed from the ticking and the fire barrier fabric attached to the foam base, at least one gusset being formed between the mattress and the at least one pillow top, the at least one gusset having first and second sidewalls formed from the ticking, the fire barrier fabric with the foam base attached thereto, the gusset sidewalls forming an apex within the at least one gusset, the fire retardant stitching thread securing the gusset walls at the apex, each of the gusset walls having an end distal from the apex, the end of the first gusset sidewall forming a joint with the cover from the pillow top, wherein the ticking, the fire barrier fabric and the foam are sandwiched between the fire retardant tape and are held together by the fire retardant thread, the end of the second gusset sidewall forming a joint with the cover from the pillow top, wherein the ticking, the fire barrier fabric and the foam are sandwiched between the fire retardant tape and are held together by the fire retardant thread, the end of second gusset sidewall forming a joint with the mattress, wherein the ticking, the fire barrier fabric and the foam are sandwiched between the fire retardant tape and are held together by the fire retardant thread.

* * * * *